US005678255A

United States Patent [19]

Stoudamire, Sr.

[11] Patent Number: 5,678,255

[45] Date of Patent: Oct. 21, 1997

[54] PORTABLE HAIR WASHING SYSTEM

[76] Inventor: Melvin C. Stoudamire, Sr., 629 Russell St., Toledo, Ohio 43608

[21] Appl. No.: 571,390

[22] Filed: Dec. 13, 1995

[51] Int. Cl.[6] ..... A45D 19/04

[52] U.S. Cl. ..... 4/516; 4/518; 4/519

[58] Field of Search ..... 4/516, 519, 645, 4/625, 599

[56] References Cited

U.S. PATENT DOCUMENTS

| | | | |
|---|---|---|---|
| 3,068,491 | 12/1962 | Perekrestenko . | |
| 3,523,306 | 8/1970 | Sabella | 4/519 X |
| 3,925,828 | 12/1975 | Kim | 4/599 |
| 4,081,867 | 4/1978 | Simeola . | |
| 4,455,696 | 6/1984 | Assanah et al. | 4/516 X |
| 4,651,361 | 3/1987 | Nolan | 4/516 |
| 4,675,923 | 6/1987 | Ashley | 4/599 |
| 4,769,863 | 9/1988 | Tegg et al. | 4/625 |
| 5,305,481 | 4/1994 | Nebb | 4/516 |

FOREIGN PATENT DOCUMENTS

| | | | |
|---|---|---|---|
| 0051350 | 1/1911 | Germany | 4/519 |

*Primary Examiner*—Charles E. Phillips
*Attorney, Agent, or Firm*—Joseph N. Breaux

[57] ABSTRACT

A portable hair washing system that has a collapsible basin table for transporting is provided. The portable hair washing system comprises: a collapsible basin table having a top member supported by a plurality of telescopic legs; a first collapsible container having a spout; a second collapsible container having a spout; a first flexible conduit having a connector end and a nozzle end; and a second flexible conduit having a first and second connector end. The top member forms a basin approximate the front surface of the top member. The basin has a depending side wall and a bottom wall. The bottom wall forms a drain hole therethrough for draining water from the basin. The top member also has a curved portion extending downwardly from the front surface of the top member into the basin. The curved portion forms a neck surface extending into the basin for resting the neck of user. The portable hair washing system may also have a collapsible tray assembly and a case for carrying the equipment in.

9 Claims, 2 Drawing Sheets

PORTABLE HAIR WASHING SYSTEM

TECHNICAL FIELD

The present invention relates to devices for washing hair and more particularly to devices for washing hair that are portable and light weight for use by nurses and the like for washing the hair of the bedridden and disabled.

BACKGROUND ART

It is quite well known that it is extremely difficult to properly shampoo persons' heads when they are confined to a reclining position in bed. This is especially true since it requires an initial wetting of a relatively large volume of hair in some instances with a subsequent soaping or washing after which the cleaning agent has to be rinsed from the hair. The several operations are quite difficult to perform when a person is confined to the ed or when a person cannot comfortably assume the position normally required for shampooing which requires that the head be bent forwardly or placed into or in overlying relation to a sink or the like.

It would be a benefit, therefore, to have a basin for washing a person hair that is lightweight and compact for transporting. It would be a further benefit, to have a basin supported by telescopic legs for elevating the basin for use and for lowing for storing and transporting. It would be an additional benefit to have a first collapsible container in fluid communication with a nozzle for dispersing water from the container. It would be an even further benefit, to have a second collapsible container in fluid communication with the basin for containing the used or dirty water. It would be a still further benefit to have a case for storing and transporting the portable hair washing system.

GENERAL SUMMARY DISCUSSION OF INVENTION

It is thus an object of the invention to provide a portable hair washing system that has a collapsible basin table having a basin supported by telescopic legs.

It is a further object of the invention to provide a portable hair washing system that has a first collapsible container for holding clean water in fluid communication with a nozzle end and a second collapsible container in fluid communication with the basin for capturing the used water.

It is a still further object of the invention to provide a portable hair washing system that has a collapsible tray assembly having a shelf supported by collapsible legs.

It is a still further object of the invention to provide a portable hair washing system that has a case for storing and transporting the portable hair washing system.

Accordingly, a portable hair washing system that has a collapsible basin table for transporting is provided. The portable hair washing system comprises: a collapsible basin table having a top member supported by a plurality of telescopic legs; a first collapsible container having a spout; a second collapsible container having a spout; a first flexible conduit having a connector end and a nozzle end; and a second flexible conduit having a first and second connector end.

The top member forms a basin approximate the front surface of the top member. The basin has a depending side wall and a bottom wall. The bottom wall forms a drain hole therethrough for draining water from the basin. The top member also has a curved portion extending downwardly from the front surface of the top member into the basin. The curved portion forms a neck surface extending into the basin for resting the neck of user.

The connector end of the first flexible conduit is fluidly connectable to the spout of the first collapsible container. With the connector end connected to the first container the nozzle end of the first conduit is in fluid connection with the first container for dispersing water from the first container over the user's head.

The first connector end of the second flexible conduit is fluidly connectable to the spout of the second collapsible container. The second connector end of the second conduit is connectable to the basin via the drain hole of the basin in a manner such that the basin and the second collapsible container are in fluid communication.

The telescopic leg include an anterior leg member functionally connected to a medial leg member so that the medial leg is retractable into and extendable from the anterior leg. The telescopic leg may include a posterior leg functionally connected to the medial leg so that the posterior leg is retractable into and extendable from the medial leg. With the posterior leg the basin table may be collapsed into a smaller unit. Preferably, a caster wheel is connected to the distal end of the telescopic leg.

In a preferred embodiment, the portable hair washing system also has a carrying case for storing and transporting the collapsible basin table when the telescopic legs are retracted and the other associated system parts. The carrying case has a top section hingedly connected to a bottom section. The carrying case includes a locking mechanism in connection between the top and bottom sections for maintaining the carrying case in a closed relationship. The carrying case may also include a handle for ease in transporting the portable hair washing system.

The portable hair washing system may also include a collapsible tray assembly. The tray assembly having a first shelf supported by collapsible legs. The tray assembly may further include a second shelf connected between the collapsible legs. The first and second shelf may be either rigidly connected to form the tray assembly or may be hingedly connected. Preferably, the collapsible tray assembly is extendable to a height such that the first shelf is above the top member of the basin table. In this embodiment, the carrying case is sized to fit both the collapsible basin table and collapsible tray assembly and the associated equipment.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
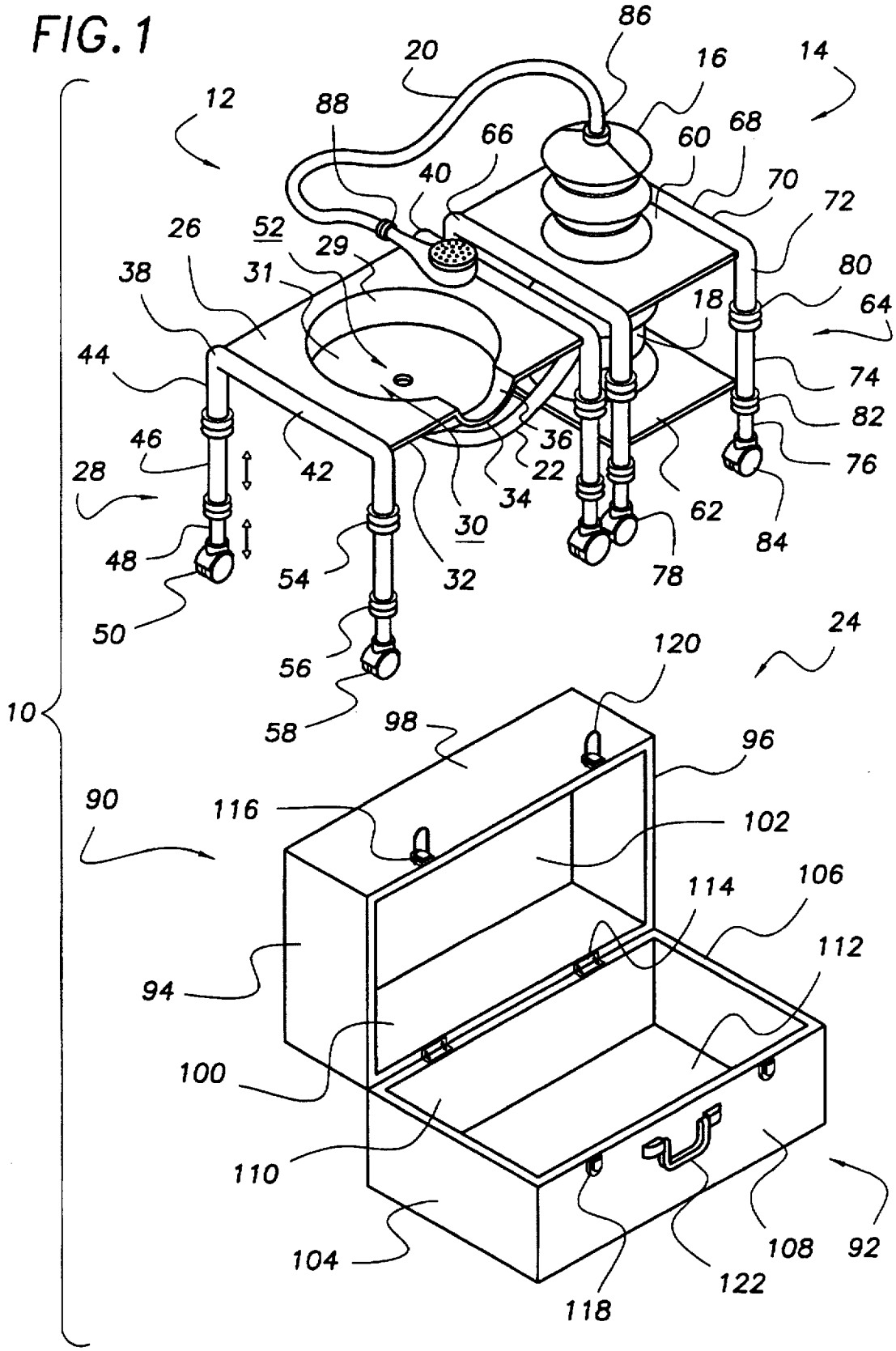
FIG. 1 is a perspective view of an exemplary embodiment of the portable hair washing system of the present invention.

FIG. 1 is a perspective view of an exemplary embodiment of the portable hair washing system of the present invention generally designated by the numeral 10. System 10 includes a collapsible basin table 12, a collapsible tray assembly 14, a first collapsible container 16, a second collapsible container 18, a first flexible conduit 20, a second flexible conduit 22 and a carrying case 24.

Basin table 12 includes a top member 26 supported by four telescopic legs 28. A basin 30 extends downwardly from top member 26 approximate a front surface 32 of top member 26. Basin 30 has a substantially circular depending side wall 29 and a bottom wall 31. Bottom wall 31 forms a drain hole 52 therethrough approximate the center point thereof. As shown, top member 26 and basin 30 are integrally constructed of a substantially rigid, molded plastic.

Top member 26 has a curved portion 34 extending downwardly from front surface 32 into basin 30. Curved portion 34 has a curved neck surface 36 for supporting the neck of a user (not shown) with the user's head extending into basin 30. Curved neck surface 36 at its lowest point remains at least one inch above bottom wall 31. Neck surface 36 is semi-circular and at least three inches in width to comfortably support the user's neck.

Basin table 12 also includes a first and second U-shaped frame member 38, 40. Frame members 38, 40 are identical and constructed of plastic tubing. Each frame member 38, 40 has a horizontal portion 42 and a pair of anterior leg members 44 extending perpendicularly, downward from horizontal portion 42. Top member 26 is connected between horizontal portions 42 of frame members 38, 40 with front surface 32 being perpendicular to each horizontal portion 42.

Each telescopic leg 28 includes anterior leg member 44, a medial leg member 46, a posterior leg member 48 and a caster wheel 50. Medial leg member 46 is retractable into and extendable from anterior leg member 44. Medial leg member 46 and anterior leg member 44 are functionally connected by a first compression fitting 54. Posterior leg member 48 is retractable into and extendable from medial leg member 46. Posterior leg member 48 and medial leg member 46 are functionally connected by a second compression fitting 56. Caster wheels 50 are connected to the distal end 58 of each posterior leg member 48.

Collapsible tray assembly 14 includes a first and second shelf 60, 62 supported by four collapsible legs 64. First shelf 60 is constructed of plastic and is mounted between a left and right U-shaped frame member 66, 68.

U-shaped frame members 66, 68 are identical to one another and constructed of plastic tubing. Each frame member 66, 68 has a horizontal portion 70 and a pair of outer leg members 72 extending perpendicularly, downward from horizontal portion 70.

Each collapsible leg 64 includes outer leg member 72, a first inner leg member 74, a second inner leg member 76 and a caster wheel 78. First inner leg member 74 is retractable into and extendable from outer leg member 72. First inner leg 74 and outer leg 72 are functionally connected by a top compression fitting 80. Second inner leg member 76 is extendable from and retractable into first inner leg member 74. Second inner leg 76 and first inner leg 74 are functionally connected by a bottom compression fitting 82. Caster wheels 78 are connected to the distal end 84 of each second inner leg member 76.

First and second shelf 60, 62 are the same size and constructed of a substantially square piece of plastic. First shelf 60 is connected between horizontal portions 70, substantially parallel to the supporting surface. Second shelf 62 is connected between first inner leg members 74 just above bottom compression fittings 60, such that, first inner legs 74 can be retracted into outer legs 72 substantially their entire length. Second shelf 62 is mounted so that it is parallel to the supporting surface and first shelf 60.

First and second collapsible containers 16, 18 are identical in construction and size. Containers 16 and 18 are accordion type containers constructed of a flexible plastic. Containers 16 and 18 are adapted for holding one gallon of water. Each container 16, 18 has a spout (not shown) having external threading.

First flexible conduit 20 has a connector end 86 and a nozzle end 88. Connector end 86 has internal threading for fluidly connecting to the spout of first collapsible container 16. Nozzle end 88 is adapted for dispersing water from container 16 over the head of a user.

Second flexible conduit 22 has a first and second connector end (not shown). The first connector end is fluidly connectable to the spout of second collapsible container 18. The second connector end is fluidly connectable to basin 30 through drain hole 52. When the first connector end is connected to second collapsible container 18 and the second connector end is connected to basin 30, basin 30 and container 18 are in fluid communication for draining water from basin 30.

Carrying case 24 includes a top section 90 and a bottom section 92. Top 90 and bottom 92 are substantially square and identical in length and width such that when they are facewise disposed upon each other in marginal registration they define an enclosed compartment therebetween. Top and bottom sections 90, 92 are constructed of a rigid, lightweight plastic.

Top section 90 includes a first side wall 94, a second side wall 96, a front wall 98, a rear wall 100 and a top wall 102. First and second side wall 94, 96 are parallel to one another and interconnected by front and rear wall 98, 100. Top wall 102 interconnects walls 94, 96, 98 and 100 to form a five sided box.

Bottom section 92 includes a left side wall 104, a right side wall 106, a first lateral wall 108, a second lateral wall 110 and a bottom wall 110. Left and right side wall 104, 106 are parallel to one another and interconnect lateral walls 108, 110. Bottom wall 112 interconnects walls 104, 106, 108 and 110 to form a five sided box.

Top section 90 and bottom section 92 are hingedly connected by hinges 114. Hinges 114 are connected between rear wall 100 of top section 90 and second lateral wall 110 of bottom section 92.

Carrying case 24 includes a locking mechanism comprising a clasp 116 and a tab 118 for locking top and bottom section 90, 92 in a closed position. Clasps 116 have a movable latch and are connected to front wall 98 of top section 90. Taps 118 extend from first lateral wall 108 in a position aligned with clasps 116 when top section 90 is facewise disposed upon bottom section 92. To lockably close carrying case 24, latch 120 is disposed over tab 118. Carrying case 24 further includes a handle 122 connected to first lateral wall 108.

Figure 2:
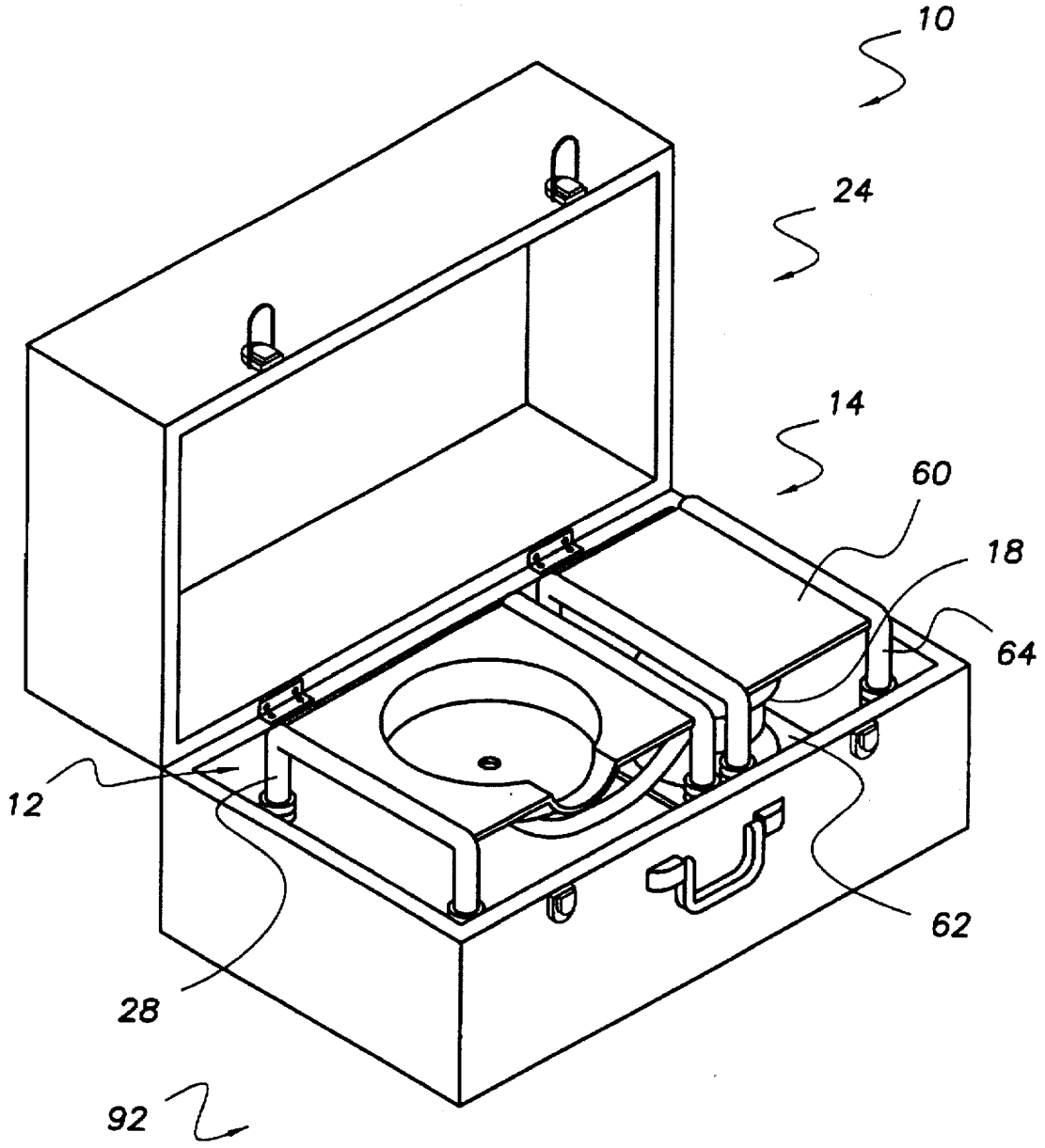
FIG. 2 is a an elevated, perspective view of the portable hair washing system.

FIG. 2 is an elevated, perspective view of portable hair washing system 10. As shown, collapsible basin table 12 and collapsible tray assembly 14 are stored within bottom section 92 of carrying case 24.

To store basin table 12, telescopic legs 28 are retracted reducing the height of basin table 12. Tray assembly 14 is stored by retracting collapsible legs 64 and placing tray assembly 14 adjacent basin table 12. Second collapsible container 18 is shown partially collapsed and stored between first and second shelf 60, 62. First collapsible container (not shown) is stored in the same manner.

Use of portable hair washing system 10 is now described with reference to FIGS. 1 and 2. Basin table 12, tray assembly 14, first and second collapsible container 16, 18, and first and second flexible conduit 20,22 are removed from carrying case 24. Telescopic legs 28 of basin table 12 are extended by the operator so that the user may place his/her head within basin 30 with the user's neck comfortably resting on neck surface 36. Telescopic legs 28 are extended evenly so that top member 26 is parallel to the supporting surface.

Collapsible tray assembly 14 is raised in the same manner as basin table 12. Tray assembly 14 is raised so that first shelf 60 is above top member 26 of basin table 12.

First collapsible container 16 is filled with water and placed atop first self 60 of tray assembly 14. Connector end 86 of first flexible conduit 20 is fluidly connected to first container 16. Second flexible conduit 22 is then fluidly connected between basin 30 and second collapsible container 18.

The user's head is then placed into basin 30, the operator washing the user's hair by urging water out of container 16 by either compressing container 16 or by gravity through first conduit 20 and dispersing the water through nozzle end 88 over the user's hair. The water then drains from basin 30 through drain hole 52, second conduit 22 into second container 18.

Once the user's hair is washed, the dirty water is emptied from second container 18 and any water remaining in first bottle 16 is emptied. Basin table 12 and tray assembly 14 are then lowed by reversing the process for raising and are placed back into carrying case 24.

It can be seen from the preceding description that a device for washing hair which has a collapsible basin table having a basin supported by telescopic legs, has a first collapsible container for holding clean water in fluid communication with a nozzle end and a second collapsible container in fluid communication with the basin for capturing the used water, has a collapsible tray assembly having a shelf supported by collapsible legs, and has a case for storing and transporting the portable hair washing system has been provided.

It is noted that the embodiment of the portable hair washing system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A portable hair washing system comprising:

a collapsible basin table having a top member supported by a plurality of telescopic legs, said top member forming a basin having a depending side wall and a bottom wall, said bottom wall forming a drain hole therethrough for draining water from said basin, said basin being formed approximate a front surface of said top member, said front having a curved portion extending downwardly therefrom into said basin, said curved portion having a neck surface for resting the neck of a user;

a caster wheel connected to a distal end of each said telescopic leg of said collapsible basin table;

a first collapsible container adapted for holding water, said first collapsible container having a spout;

a second collapsible container adopted for holding water, said second collapsible container having a spout;

a first flexible conduit having a connector end and a nozzle end, said connector end being fluidly connectable to said spout of said first collapsible container;

a second flexible conduit having a first and second connector end, said first connector end being fluidly connectable to said spout of said second collapsible container, said second connector end being connectable to said basin via said drain hole formed by said bottom wall of said basin in a manner such that said basin and said second collapsible container are in fluid communication; and a carrying case having a top section hingedly connected to a bottom section for storing said collapsible basin table therein when said telescopic legs are retracted, said top section having a first side wall, a second side wall, a front wall, a rear wall and a top wall, said first and said second side wall being parallel to one another and interconnected by said front and said rear wall, said top wall interconnecting said first side wall, said second side wall, said front wall and said rear wall to form a five sided box; and said bottom section having a left side wall, a right side wall, a first lateral wall, a second lateral wall and a bottom wall, said left and said right side wall being parallel to one another and interconnected by said first and said second lateral side wall, said bottom wall interconnecting said left side wall, said right side wall, said first lateral wall and said second lateral wall to form a five sided box;

a collapsible tray assembly having a first shelf supported by a plurality of collapsible legs, each said collapsible leg having a caster wheel attached to a distal end thereof.

2. The portable hair washing system of claim 1, wherein:

said carrying case is sized to store said collapsible basin table and said collapsible tray assembly therein; and said carrying case further includes:

a locking mechanism in connection between said top section and said bottom section for lockably closing said carrying case; and a handle connected to said carrying case.

3. The portable hair washing system of claim 2, wherein:

said telescopic leg of said collapsible basin table includes an anterior leg member functionally connected to a medial leg member, said medial leg member being retractable into and extendable from said anterior leg member.

4. The portable hair washing system of claim 3, wherein:

said telescopic leg of said collapsible basin table further includes a posterior leg member functionally connected to said medial leg member, said posterior leg member being retractable into and extendable from said medial leg member.

5. The portable hair washing system of claim 4, wherein:

said collapsible leg of said collapsible tray assembly includes an outer leg member functionally connected to a first inner leg member, said first inner leg member being retractable into and extendable from said outer leg member.

6. The portable hair washing system of claim 5, wherein:

said collapsible tray assembly further includes a second shelf connected between said first inner leg members of said collapsible legs.

7. The portable hair washing system of claim 6, wherein:

said collapsible leg of said collapsible tray assembly includes:

an outer leg member functionally connected to a first inner leg member, said first inner leg member being retractable into and extendable from said outer leg member; and a second inner leg member functionally connected to said first inner leg member, said second inner leg member being retractable into and extendable from said first inner leg member.

8. The portable hair washing system of claim 7, wherein:

said collapsible tray assembly further includes a second shelf connected between said first inner leg members of said collapsible legs.

9. A portable hair washing system comprising:

a collapsible basin table having a top member supported by a plurality of telescopic legs, said top member forming a basin having a depending side wall and a bottom wall, said bottom wall forming a drain hole therethrough for draining water from said basin, said basin being formed approximate a front surface of said top member, said front surface having a curved portion extending downwardly therefrom into said basin, said curved portion having a neck surface for resting the neck of a user;

a collapsible tray assembly having a first shelf supported by a plurality of collapsible legs;

a second shelf in connection between said collapsible legs of said collapsible tray assembly;

a first collapsible container adapted for holding water, said first collapsible container having a spout;

a second collapsible container adapted for holding water, said second collapsible container having a spout;

a first flexible conduit having a connector end and a nozzle end, said connector end being fluidly connectable to said spout of said first collapsible container;

a second flexible conduit having a first and second connector end, said first connector end being fluidly connectable to said spout of said second collapsible container, said second connector end being connectable to said basin via said drain hole formed by said bottom wall of said basin in a manner such that said basin and said second collapsible container are in fluid communication;

a carrying case having a top section hingedly connected to a bottom section for storing said collapsible basin table therein when said telescopic legs are retracted and said collapsible tray assembly when said collapsible legs are retracted, said top section having a first side wall, a second side wall, a front wall, a rear wall and a top wall, said first and said second side wall being parallel to one another and interconnected by said front and said rear wall, said top wall interconnecting said first side wall, said second side wall, said front wall and said rear wall to form a five sided box; and said bottom section having a left side wall, a right side wall, a first lateral wall, a second lateral wall and a bottom wall, said left and said right side wall being parallel to one another and interconnected by said first and said second lateral side wall, said bottom wall interconnecting said left side wall, said right side wall, said first lateral wall and said second lateral wall to form a five sided box;

a locking mechanism in connection between said top section and said bottom section of said carrying case for lockably closing said carrying case; and a handle connected to said carrying case;

wherein said telescopic leg of said collapsible basin table includes:

an anterior leg member functionally connected to a medial leg member, said medial leg member being retractable into and extendable from said anterior leg member;

a posterior leg member functionally connected to said medial leg member, said posterior leg member being retractable into and extendable from said medial leg member; and a caster wheel connected to a distal end of said posterior leg; and wherein said collapsible leg of said collapsible tray assembly includes:

an outer leg member functionally connected to a first inner leg member, said first inner leg member being retractable into and extendable from said outer leg member;

a second inner leg member functionally connected to said first inner leg member, said second inner leg member being retractable into and extendable from said first inner leg member; and a caster wheel connected to a distal end of said second inner leg member.

* * * * *